US006280021B1

(12) United States Patent
Wu et al.

(10) Patent No.: US 6,280,021 B1
(45) Date of Patent: Aug. 28, 2001

(54) STRUCTURE OF INK SLOT ON INK-JET PRINTHEAD CHIP

(75) Inventors: Yi-Yung Wu, Taichung Hsien; Je-Ping Hu, Lu-Chou; Yi-Hsuan Lai, Hsinchu; Yuh-Horng Chuang, Hsin-Chuang; Chieh-Wen Wang, Hsinchu, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/270,347

(22) Filed: Mar. 16, 1999

(30) Foreign Application Priority Data

Jun. 15, 1998 (TW) ..... 87109469

(51) Int. Cl.[7] ..... B41J 2/045
(52) U.S. Cl. ..... 347/65; 347/40

(58) Field of Search ..... 347/57, 65, 63, 347/85, 47, 40

(56) References Cited

U.S. PATENT DOCUMENTS 5,608,436 * 3/1997 Baughman et al. ..... 347/65
6,003,977 * 12/1999 Weber et al. ..... 347/63

* cited by examiner

*Primary Examiner*—John Barlow
*Assistant Examiner*—Craig A. Hallacher
(74) *Attorney, Agent, or Firm*—Jiawei Huang; J. C. Patents

(57) ABSTRACT

A structure of ink slots on an ink-jet printhead chip. The structure includes a plurality of firing chambers and a plurality of ink reservoirs. Each of the firing chambers has a heater and is enclosed by a plurality of walls, so each of the firing chambers is isolated. The ink reservoirs are respectively connected to the firing chambers by ink slots and each of the ink reservoirs is also isolated. Additionally, distances of the ink slots are equal.

14 Claims, 2 Drawing Sheets

STRUCTURE OF INK SLOT ON INK-JET PRINTHEAD CHIP

CROSS-REFERENCE TO RELATED APPLICATION

This application claims the priority benefit of Taiwan application serial no. 87109469, filed Jun. 15, 1998, the full disclosure of which is incorporated herein by reference.

BACKGROUND OF THE INVENTION

1. Field of the Invention

The present invention relates to a thermal ink-jet printer. More particularly, the present invention relates to a structure of ink slots on an ink-jet printhead chip.

2. Description of the Related Art

In thermal ink-jet printer technology, a single ink reservoir on a printhead chip is used to provide inks for all firing chambers formed on the chip. The ink reservoir is connected to the firing chambers by ink slots on the chip. In the practice, the firing chambers are not aligned.

FIG. 1 is a schematic diagram showing a conventional thermal ink-jet printhead chip structure.

Referring to FIG. 1, a plurality of firing chambers 14 is formed on an ink-jet printhead chip 10. Each of the firing chambers 14 has a heater 14*a* and is connected to a common ink reservoir 12 on the printhead chip 10. In the practice, the firing chambers 14 are not aligned. As shown by the arrangement illustrated in FIG. 1, a distance between each firing chamber 14 and the ink reservoir 12 is not the same. For example, distances 16 and 18 are L1 and L2, respectively.

FIG. 2 is a schematic diagram showing a part of the thermal ink-jet printhead chip structure illustrated in FIG. 1.

Referring to FIG. 2, an ink flow 22 moves toward a firing chamber 26 when the firing chamber 26 is filling with ink from the ink reservoir 12 to prepare for a printing process. Operations of adjacent firing chambers 24 and 28 are disturbed because the pathway of the ink, which fills the firing chambers 24 and 28, is disturbed by the ink flow 22. Response time of the firing chambers 24 and 28 both become longer. Furthermore, a cross talk effect easily occurs between adjacent firing chambers when they operate at the same time or in sequence.

In the foregoing, the distance between each firing chamber and the ink reservoir is not equal, thus a dynamic response of each ink flow is different. Additionally, frequency response is also different for each firing chamber.

In conventional practice, the firing chambers share a single ink reservoir. During the printing process, disturbances occur between the firing chambers, thus the response time of the firing chambers become longer.

SUMMARY OF THE INVENTION

Accordingly, the present invention provides a structure of ink slots used on an ink-jet printhead chip, in which each firing chamber is a same distance from its respective ink reservoir, and avoids the cross talk effect.

To achieve these and other advantages and in accordance with the purpose of the invention, as embodied and broadly described herein, the invention provides a structure of ink slots used on an ink-jet printhead chip. The structure includes a plurality of firing chambers and a plurality of ink reservoirs. Each of the firing chambers has a heater and is enclosed by a plurality of walls, so each of the firing chambers is isolated. The ink reservoirs are respective connected to the firing chambers by ink slots and each of the ink reservoirs is also isolated. Additionally, distances of the ink slots are equal.

The structure in the invention is that of a single firing chamber connected to a single ink reservoir. Additionally, distance between each firing chamber and each ink reservoir is equal so that frequency response of each firing chamber is equal. The cross-talk effect is avoided because the firing chamber and the ink reservoir are both isolated.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
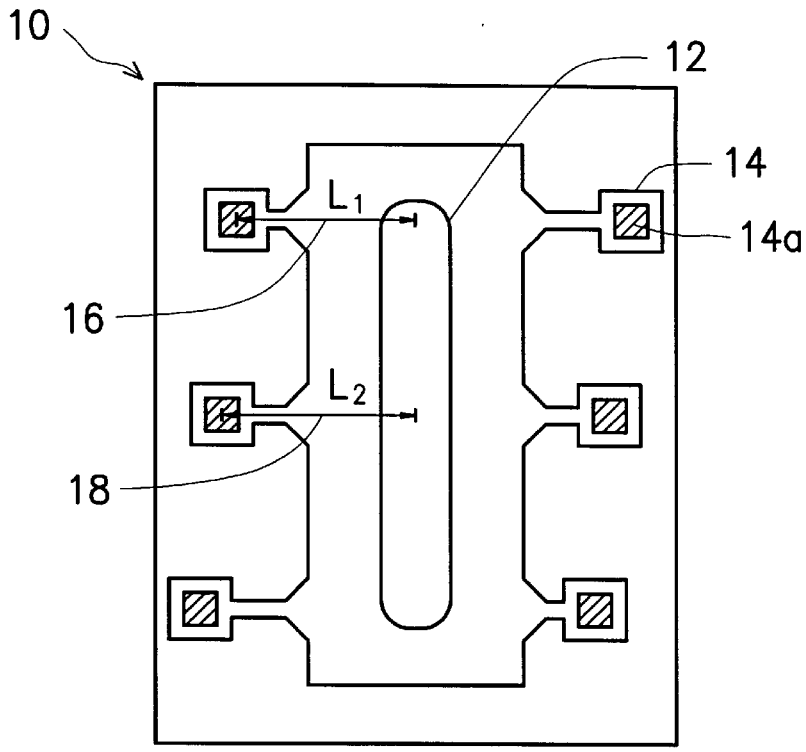
FIG. 1 (PRIOR ART)
FIG. 1 is a schematic diagram showing a conventional thermal ink-jet printhead chip structure.
Figure 2:
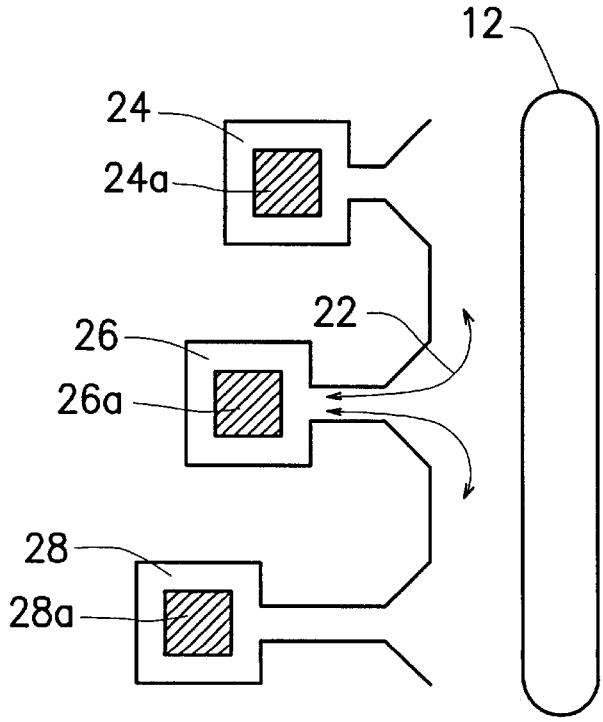
FIG. 2 (PRIOR ART)
FIG. 2 is a schematic diagram showing a part of the thermal ink-jet printhead chip structure shown in FIG. 1.

Reference will now be made in detail to the present preferred embodiments of the invention, examples of which are illustrated in the accompanying drawings. Wherever possible, the same reference numbers are used in the drawings and the description to refer to the same or like parts.

Figure 3A:
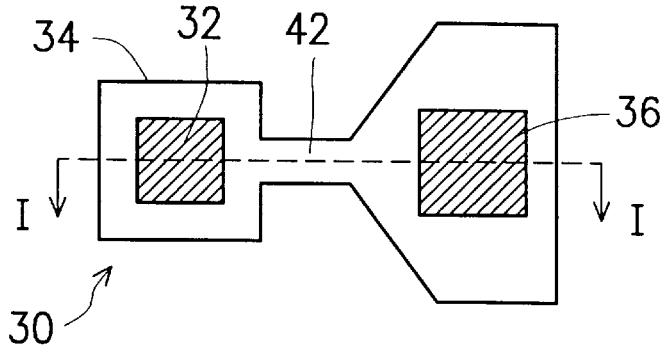
FIG. 3A is a schematic diagram showing a preferred embodiment according to the invention.

FIG. 3A is a schematic diagram showing a preferred embodiment according to the invention.

Referring to FIG. 3A, a heater 32 is located in a firing chamber 30. The firing chamber 30 is enclosed by a plurality of walls 34, so that the firing chamber 30 is isolated from other firing chambers. The firing chamber 30 is connected to an ink reservoir 36 by an ink slot 42. The ink reservoir 36 is also isolated from other ink reservoirs and the ink reservoir 36 is only connected to the firing chamber 30. Since a single firing chamber 30 is connected to a single ink reservoir 36, the distance between the firing chamber 30 and the ink reservoir 36 is designed to be the same regardless of whether or not the firing chambers are aligned.

As the structure mentioned above, the frequency response of each firing chamber 30 is the same because the distance between the firing chamber 30 and the ink reservoir 36 in the invention is the same. The printing results are uniform due to the same frequency response of each firing chamber 30. Furthermore, the cross talk effect is avoided because single firing chamber 30 is connected to single ink reservoir 36, and the firing chamber 30 and the ink reservoir 36 are both isolated.

Figure 3B:
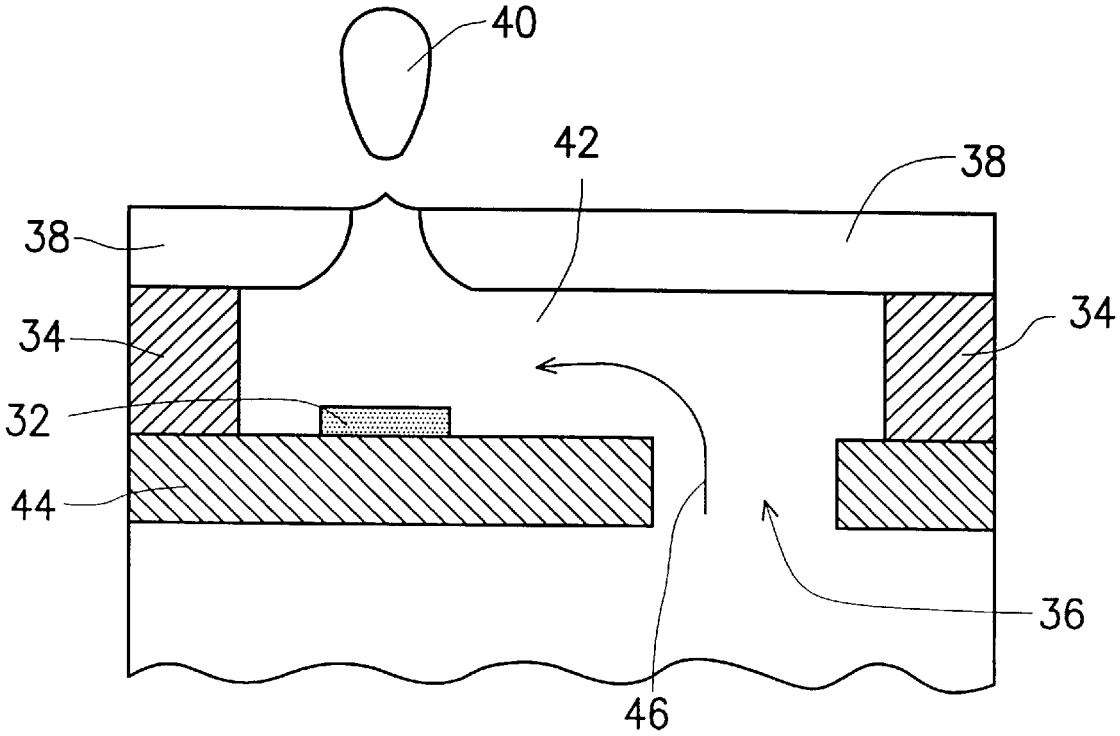
FIG. 3B is a schematic, cross-sectional view of FIG. 3A along a line I—I.

FIG. 3B is a schematic, cross-sectional view of FIG. 3A along a line I—I.

Referring to FIG. 3B, the firing chamber 30 (FIG. 3A) is enclosed by the walls 34. A nozzle plate 38 is positioned over the firing chamber 30. The ink reservoir 36 formed on a chip 44 is connected to the firing chamber 30. The step of forming the ink reservoir 36 includes anisotropic etching, a laser or sandblasting.

After receiving a signal, the heater 32 is heated to form a bubble (not shown). The ink is pushed toward the nozzle plate 38 by the bubble, and an ink droplet 40 is expelled. Then, the bubble is shrunk and the firing chamber 30 is refilled with ink from the ink reservoir 36 along a path 46. A cycle of the printing process is completed. During the cycle, the dynamic response of the ink flow of each firing chamber 30 is equal so that the frequency response of each firing chamber 30 is also equal and the printing result is uniform. Additionally, the cross-talk effect between adjacent firing chambers is reduced because each firing chamber 30 is isolated.

In the invention, the distance between each firing chamber and the corresponding ink reservoir is the same, thus the frequency response of each firing chamber is equal.

Furthermore, the firing chambers in the invention are isolated. The cross-talk effect is avoided.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A structure of ink slots used on an ink-jet printhead chip, comprising:

a plurality of firing chambers, wherein each of the firing chambers has a heater and is enclosed by a plurality of walls; and a plurality of ink reservoirs, wherein each of the ink reservoirs is connected to one of the firing chambers and a distance between each of the firing chambers and the corresponding ink reservoirs is the same.

2. The structure of claim 1, wherein the firing chambers are aligned.

3. The structure of claim 1, wherein the firing chambers are not aligned.

4. The structure of claim 1, wherein the firing chambers are formed on a silicon substrate in the ink-jet printhead chip.

5. The structure of claim 4, wherein the ink reservoirs are manufactured by anisotropic etching.

6. The structure of claim 4, wherein the ink reservoirs are manufactured by a laser.

7. The structure of claim 4, wherein the ink reservoirs are manufactured by sandblasting.

8. The structure of claim 1, wherein the printhead chip is used in a thermal ink-jet printer.

9. A structure of ink slots used on an ink-jet printhead chip comprising:

a printhead chip including a silicon substrate;

a plurality of firing chambers, wherein each of the firing chambers has a heater; and a plurality of ink reservoirs formed on the silicon substrate of the ink-jet printhead chip, wherein the ink reservoirs are respectively connected to the firing chambers and distances between the firing chambers and the ink reservoirs are equal.

10. The structure of claim 9, wherein each of the firing chambers is enclosed by three sidewalls.

11. The structure of claim 9, wherein the ink reservoirs are manufactured by anisotropic etching.

12. The structure of claim 9, wherein the ink reservoirs are manufactured by a laser.

13. The structure of claim 9, wherein the ink reservoirs are manufactured by sandblasting.

14. A structure of an ink-jet printhead chip, comprising:

a plurality of firing chambers, wherein each of the firing chambers has a heater; and a plurality of ink reservoirs formed on a silicon substrate of the ink-jet printhead chip, wherein the ink reservoirs are respectively connected to the firing chambers and distances between the firing chambers and the ink reservoirs are equal.

* * * * *

UNITED STATES PATENT AND TRADEMARK OFFICE

CERTIFICATE OF CORRECTION

PATENT NO. : 6,280,021 B1
APPLICATION NO. : 09/270347
DATED : August 28, 2001
INVENTOR(S) : Yi-Yung Wu et al.

It is certified that error appears in the above-identified patent and that said Letters Patent is hereby corrected as shown below:

Column 3, line 38, claim 1, please replace “same.” with --same, wherein each of the ink reservoirs is isolated from each other.--

Column 4, line 23, claim 9, please replace “equal.” with --equal, and each of the ink reservoirs is isolated from each other.--

Column 4, line 40, claim 14, please replace “equal.” with --equal, and each of the ink reservoirs is isolated from each other.--

Signed and Sealed this

Eighth Day of July, 2008

JON W. DUDAS
*Director of the United States Patent and Trademark Office*